US008038464B2

(12) United States Patent
Moorehead, Jr.

(10) Patent No.: US 8,038,464 B2
(45) Date of Patent: Oct. 18, 2011

(54) ELECTRICAL CONNECTOR WITH ADAPTABLE STRAIN RELIEF HAVING CLAMPING MEMBERS OF DIFFERENT SHAPES

(75) Inventor: Joseph W. Moorehead, Jr., Galena, OH (US)

(73) Assignee: L-3 Communications Avionics Systems, Inc., Grand Rapids, MI (US)

( * ) Notice: Subject to any disclaimer, the term of this patent is extended or adjusted under 35 U.S.C. 154(b) by 0 days.

(21) Appl. No.: 12/845,364

(22) Filed: Jul. 28, 2010

(65) Prior Publication Data

US 2011/0028028 A1 Feb. 3, 2011

Related U.S. Application Data

(60) Provisional application No. 61/229,584, filed on Jul. 29, 2009.

(51) Int. Cl.
*H01R 13/58* (2006.01)

(52) U.S. Cl. ..... 439/470

(58) Field of Classification Search ..... 439/470, 439/472, 971, 571, 449, 492, 499, 452, 458
See application file for complete search history.

(56) References Cited

U.S. PATENT DOCUMENTS 3,907,396 A * 9/1975 Huber ..... 439/472
3,909,099 A 9/1975 Winkler
4,192,571 A * 3/1980 Strautz ..... 439/470
4,358,177 A 11/1982 Badolato
4,448,474 A * 5/1984 Melnychenko ..... 439/472
4,749,369 A 6/1988 Wang
4,804,342 A 2/1989 Rudy, Jr. et al.
4,840,581 A 6/1989 Leufert et al.
5,445,538 A 8/1995 Rodrigues et al.
5,980,298 A 11/1999 Johnson
6,045,394 A 4/2000 Matsuoka et al.
6,857,900 B2 * 2/2005 Kleeberger et al. ..... 439/540.1
6,899,562 B1 5/2005 Ruff et al.
6,960,100 B2 * 11/2005 Ruff et al. ..... 439/571
7,052,323 B1 5/2006 Ruff et al.

* cited by examiner

*Primary Examiner* — Chandrika Prasad
(74) *Attorney, Agent, or Firm* — Gardner, Linn, Burkhart & Flory, LLP

(57) ABSTRACT

An electrical connector for electronics applications such as avionics or the like includes an adaptable strain relief feature for accommodating different sizes of wire bundles that terminate and are electrically coupled within the connector. The strain relief feature includes a pair of clamping members that span between mounting surfaces at a rear portion of the connector to define a strain relief passageway in which the wire bundle is clamped to provide a strain relief. The clamping members are selectable from at least two different available shapes so that the size of the strain relief passageway is determined by the selection of clamping members, which may be interchangeable with one another. Resilient pads on the clamping members engage and compress against the wire bundle to secure it in place when the selected clamping members are installed.

19 Claims, 5 Drawing Sheets

ELECTRICAL CONNECTOR WITH ADAPTABLE STRAIN RELIEF HAVING CLAMPING MEMBERS OF DIFFERENT SHAPES

CROSS REFERENCE TO RELATED APPLICATION

The present application claims the benefit of U.S. provisional application, Ser. No. 61/229,584, filed Jul. 29, 2009, which is hereby incorporated herein by reference in its entirety.

FIELD OF THE INVENTION

The present invention relates generally to electrical connectors, and more particularly, to electrical connectors used to couple bundled wires to electronic assemblies or other connectors.

BACKGROUND OF THE INVENTION

Electrical connectors typically are used to terminate bundles or ribbons of wires, and to electrically couple the wires to a corresponding coupler, electrical or electronic assembly, or the like. However, during installation, removal, or handling of wiring, the wire bundles may be subject to pulling, twisting, or other forces that can interfere with or interrupt the wires' electrical connections within a connector. To limit or prevent movement of the wires from interfering with their electrical connections, a strain relief may be used to engage the wires at a location spaced from their electrical connections inside a connector.

SUMMARY OF THE INVENTION

The present invention provides an electrical connector assembly for electrically terminating a plurality of wires, such as may be arranged in a wire bundle or ribbon, and includes an adaptable strain relief feature that permits securement of different sizes of wire bundles that terminate at the connector. A strain relief portion of the connector uses interchangeable clamp parts that are selectable based on the number and/or sizes of the wires in a wire bundle that enters a back portion of the connector. The clamp parts define a strain relief passageway with dimensions that are selectable according to the particular clamp parts being used.

According to one aspect of the invention, an electrical connector assembly includes a housing defining a cavity and a rear passageway for receiving the wires of a wire bundle. Mounting surfaces are provided at the housing for receiving first and second clamping members that engage the wire bundle. The mounting surfaces are positionable near the rear passageway of the housing. The first and second clamping members are coupleable to the mounting surfaces and fixed in spaced arrangement, such as with threaded fasteners, to define a strain relief passageway between the clamping members. The dimensions (such as the height) of the strain relief passageway are selectable according to the shapes of the first and second clamping members. Each of the clamping members is selectable from at least two different available shapes, where one of the at least two different shapes corresponds to a relatively larger strain relief passageway, and the other of the at least two different shapes corresponds to a relatively smaller strain relief passageway. Thus, the strain relief passageway is adaptable, via the selection of different shapes of clamping members, to receive different sizes or quantities of wiring (i.e. different sizes of wire bundles) entering the cavity of the housing, and to provide a strain relief to the wiring by securely clamping the wiring between the first and second clamping members.

Optionally, the clamping members may be selected so that the first and second clamping members are the same shape as one another. Alternatively, the first and second clamping members may be of different shapes. For example, the clamping members may be generally straight or flat, or may be generally U-shaped to provide extra space between the clamping members when the members are coupled to the mounting surfaces of the housing. Optionally, the clamping members are selectable from at least three different shapes corresponding to different sizes of strain relief passageway.

Optionally, the clamping members each include a resilient pad for compressively engaging the wire bundle when the first and second clamping members are coupled to the mounting surfaces of the housing. The resilient pads may be generally C-shaped including a channel for receiving the clamping members and a slot for facilitating insertion of the clamping members into the channel of the resilient pads. For example, the resilient pads may comprise an elastomeric material, and the pads may be interchangeable between the first and second clamping members by inserting a given clamping member through the slot and into the channel of a given resilient pad.

According to another aspect of the invention, a method is provided for terminating electrical wiring. The method includes providing an electrical connector assembly having a housing defining a cavity and a mounting surface, and further providing at least one wire or a wire bundle, a plurality of different clamping members, each clamping member having one of two or more different shapes, and a conventional electronic coupling assembly. The wire or wire bundle is electrically coupled to the electronic coupling assembly, which is then attached to one end of the housing. The wire or wire bundle is then routed through the cavity of the housing and out through a rear passageway in the housing. A first clamping member is selected according to shape from among the available clamping members to correspond to the size of the wire or wire bundle, and the first clamping member is coupled to the mounting surface of the housing to compress against the wire and substantially prevent a portion of the wire from moving relative to the first clamping member.

Thus, the electrical connector assembly provides a secure strain relief for electrical or electronic wire bundles, and permits an appropriate strain relief to be applied to the wire bundle as it enters the back of the connector regardless of the size of the wire bundle. By selecting from a plurality of sizes and shapes of clamping members, the size of a strain relief passageway through which the wire bundle passes as it enters the rear of the connector is adjustable to accommodate different sizes of wire bundles and secure them so that movement of the wire bundle relative to the connector does not affect the electrical connections inside the connector, thus maintaining electrical continuity and preventing wire damage or disconnections.

These and other objects, advantages, purposes, and features of the present invention will become apparent upon review of the following specification in conjunction with the drawings.

BRIEF DESCRIPTION OF THE DRAWINGS

FIG. 2 is a partially exploded perspective view of the electrical connector assembly of

FIG. 1;

FIG. 5 is a partially exploded perspective view of the electrical connector assembly of

FIG. 4;

DESCRIPTION OF THE PREFERRED EMBODIMENTS

Figure 1:
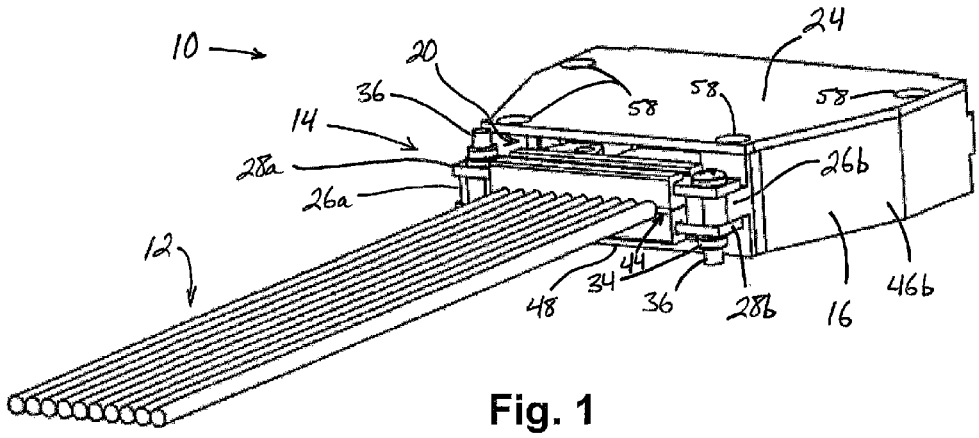
FIG. 1 is a perspective view of an electrical connector assembly receiving a single-row wire bundle, in accordance with an embodiment of the present invention.

Referring now to the drawings and the illustrative embodiments depicted therein, an electrical connector assembly 10 permits different sizes of wire bundles 12 to be electrically coupled inside the assembly while being provided with a strain relief feature 14 that is adaptable to clamp sufficiently tightly on the wire bundle 12 to substantially limit or prevent stresses and strains from being transmitted to the wire end portions inside the connector assembly (FIGS. 1 and 2) and causing fatigue. Electrical connector assembly 10 includes a connector shell or body or housing 16 that defines a cavity 18 with a rear passageway 20 and a front passageway 22 (FIG. 8), as will be described in greater detail below. Cavity 18, rear passageway 20, and front passageway 22 are at least partially covered or bounded or defined by a cover plate 24 that attaches to housing 16, and which is removable to permit access to cavity 18. A pair of tabs or projections or mounting surfaces 26*a*, 26*b* project from a rear surface of housing 16 in the vicinity of rear passageway 20, and provide mounting surfaces for strain relief feature 14. Each mounting surface 26*a*, 26*b* includes a bore 27 for receiving a fastener.

Strain relief feature 14 includes a pair of clamping members including an upper clamping member 28*a* and a lower clamping member 28*b* with a compliant or resilient pad 30 disposed along a middle portion of each clamping member. Each clamping member 28*a*, 28*b* includes bores 32*a*, 32*b* at opposite end portions thereof, with each of bores 32*a* including a threaded portion or member such as an internally-threaded locknut or weld-nut 34 or the like disposed at the bore 32*a*. Bores 32*a*, 32*b* are arranged on clamping members 28*a*, 28*b* so as to align with the respective bores 27 on each mounting surface 26*a*, 26*b*. In the illustrated embodiment, a threaded fastener 36 is insertable (without threadably engaging) into the bore 32*b* of upper clamping member 28*a* before passing through (without threading) the bore 27 in mounting surface 26*b*, and then passing through the bore 32*a* in lower clamping member 28*b* and threadably engaging the weld nut 34 positioned about the bore 32*a* of lower clamping member 28*b*. Similarly, the other threaded fastener 36 is insertable into the bore 32*b* of lower clamping member 28*b*, which lacks a weld-nut 34, before passing upwardly through bore 27 in mounting surface 26*a* and further extending through the other bore 32*a* of upper clamping member 28*a* and threading into the weld-nut 34. Because each of upper clamping member 28*a* and lower clamping member 28*b* includes a single weld-nut 34 at one of two opposite bores, clamping members 28*a*, 28*b* may be physically identical to one another and interchangeable, whereby the weld-nut 34 of one of the clamping members is aligned with mounting surface 26*a*, and the weld-nut 34 of the other clamping member is aligned with mounting surface 26*b*, with fasteners 36 inserted from opposite sides. As will be described in greater detail below, the interchangeability of the clamping members permits the use of not only identical top and bottom clamping members, but also differing shapes of clamping members to accommodate different sizes of wire bundles 12. Although threaded fasteners are shown and described for coupling the clamping members to the mounting surfaces, it will be appreciated that other coupling or fastening devices may be used such as rivets or pins or tabs and slots or the like.

Figure 3:
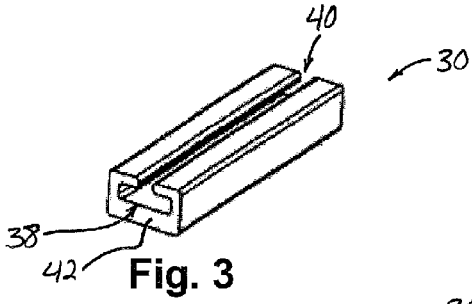
FIG. 3 is a perspective view of a resilient pad that is useful with the present invention.
Figure 2:
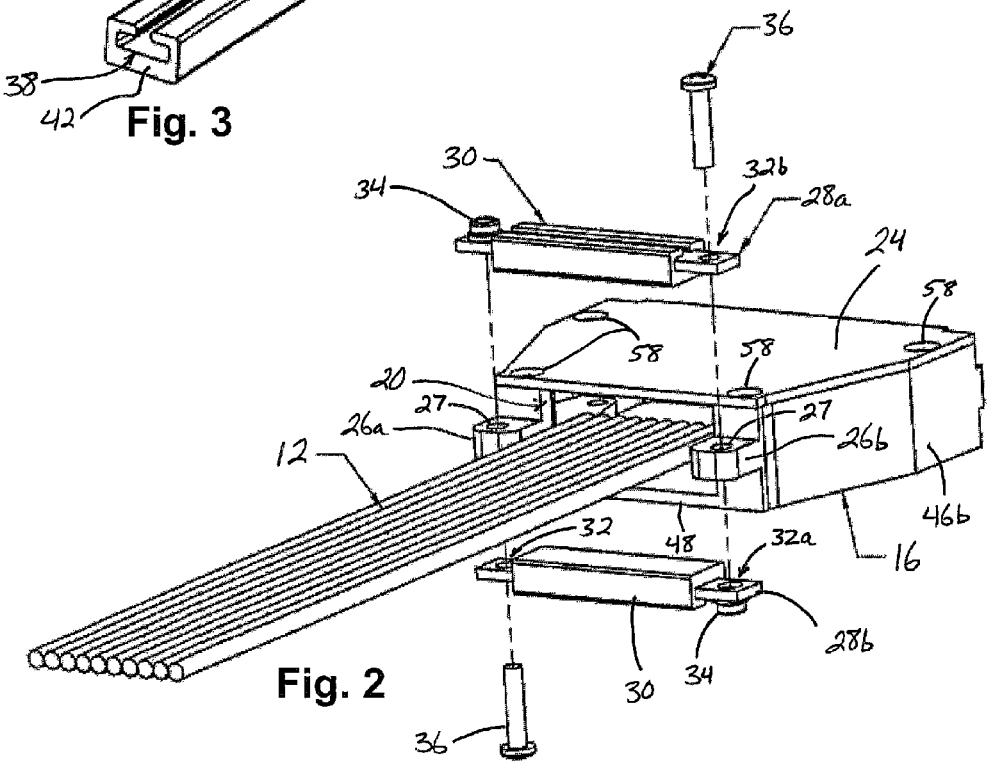

Resilient pads 30 are generally C-shaped in cross section and include a channel 38 that is open at a slot 40 (FIG. 3). Slot 40 facilitates installation of the resilient pad 30 on clamping members 28*a*, 28*b*. Resilient pads 30 are positioned on clamping members 28*a*, 28*b* with slot 40 positioned on the same side of the clamping members as weld-nut 34 so that a padded region 42 of pad 30 faces wire bundle 12, such as shown in FIGS. 1 and 2. Padded regions 42 of resilient pads 30 contact and compress against wire bundle 12 when clamping members 28 are assembled to mounting surfaces 26*a*, 26*b*. In the illustrated embodiment, the length of resilient pad 30 substantially corresponds to the width of rear passageway 20 and the space between mounting surfaces 26*a*, 26*b* so that wire bundle 12 contacts substantially only the padded material of resilient pads 30, and not the harder material of clamping members 28, for example. Resilient pads 30 may be slid onto clamping members 28 at the end opposite weld-nut 34 or, alternatively, may be flexed over a mid portion of the clamping member so that the clamping member is inserted directly through slot 40 in the resilient pad 30 to seat the clamping member within channel 38. A strain relief passageway 44 is defined between the facing surfaces of resilient pads 30 on clamping members 28*a*, 28*b*, the height of passageway 44 being adjustable according to the shape of clamping member(s) selected, as will be described.

Resilient pads 30 may be made of extruded elastomeric or compliant material, such as rubber or synthetic material such as high-durometer silicone or the like. The resilient pads may elastically or plastically deform around the wire bundle and/or the individual wires of the bundle when the proper clamping members are selected and tightened in a manner described below. The pad material may have relatively high friction properties to limit or prevent the wire bundle or individual wires thereof from slipping when the clamping members are tightened.

Figure 4:
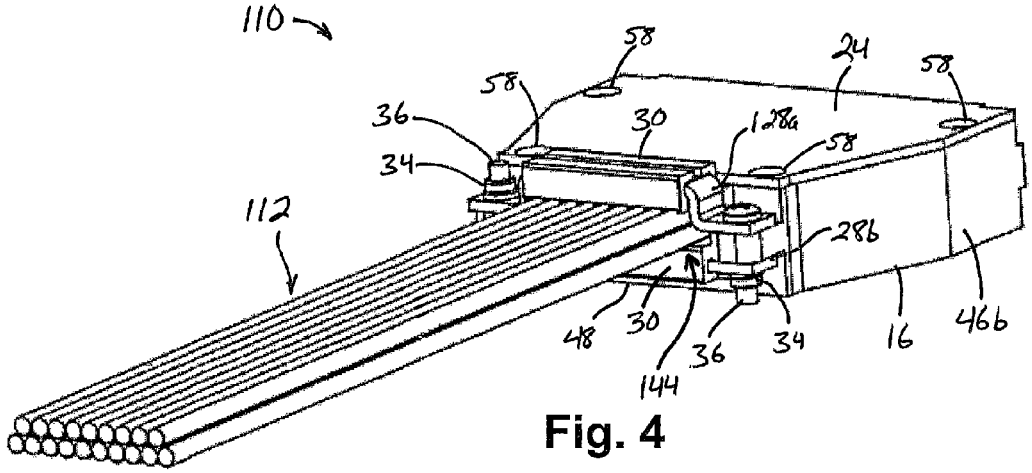
FIG. 4 is a perspective view of another embodiment of the electrical connector assembly, adapted to receive a two-row wire bundle.
Figure 5:
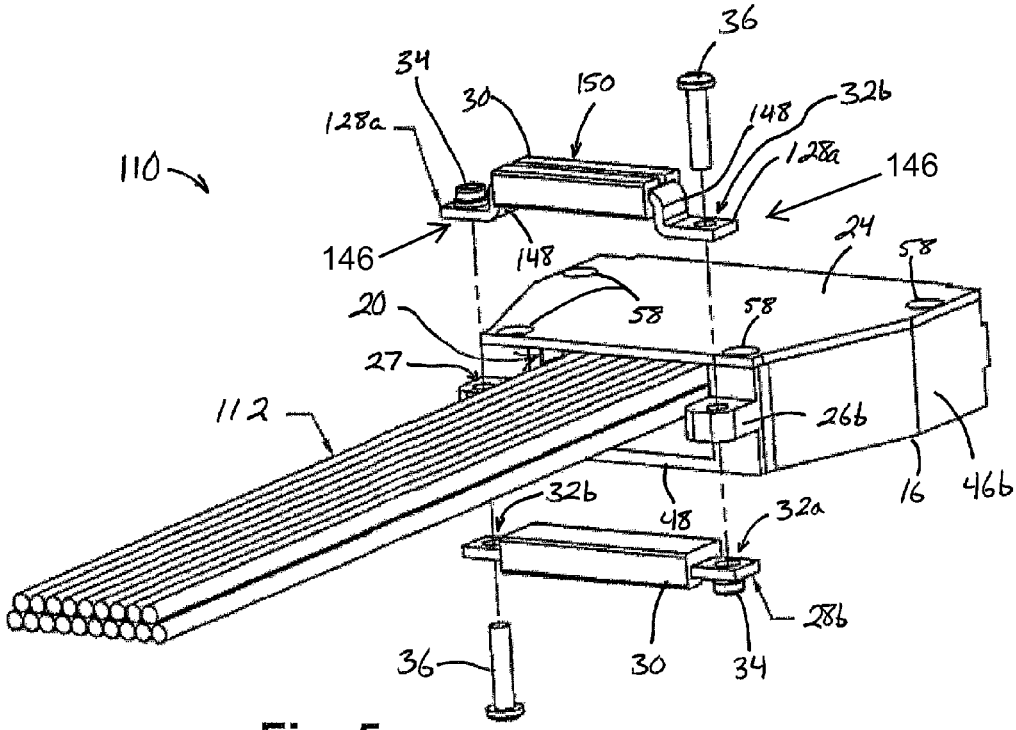

A U-shaped clamping member 128*a* may be used in place of upper clamping member 28*a* of FIGS. 1 and 2 (which is generally straight or flat), to provide an increased-height strain relief passageway 144 by increasing the space between resilient pads 30 (FIGS. 4 and 5). Thus, an electrical connector assembly 110 that is nearly identical to connector assembly 10 is readily adaptable to accommodate a wire bundle 112 having two rows of wires by simply exchanging a flat upper clamping member 28*a* for a U-shaped upper clamping member 128*a*, as shown. U-shaped clamping member 128*a* includes opposite end portions 146 that are substantially coplanar with one another and include bores 32*a*, 32*b* and a weld-nut 34 at their end portions, similar to clamping members 28*a*, 28*b*. However, each U-shaped clamping member 128*a* includes an offset arm 148 joining each opposite end portion 146 to a generally flat or straight middle region 150 of substantially similar width as the length of resilient pad 30 for receiving the resilient pad thereon (FIGS. 4-7 and 11).

It will be appreciated that, owing to the offset arms 148 of U-shaped clamping member 128*a*, resilient pads 30 cannot readily be slid axially onto the U-shaped clamping members 128*a*, so that the more suitable method for installing resilient pads on U-shaped clamping members 128*a* is through slots 40, as described above. By using an upper U-shaped clamping member 128*a* in combination with a lower straight clamping member 28*b*, as in FIGS. 4 and 5, a wire bundle of increased thickness (such as a two-row wire bundle 112) may be accommodated in the strain relief passageway 144 having an increased height relative to strain relief passageway 44. Optionally, an electrical connector assembly may be provided with one fixed clamping member (similar to one of clamping members 28*a*, 28*b* or 128*a*, 128*b*, but not readily removable from the mounting surface) and one replaceable clamping member as in one of clamping members 28*a*, 28*b* or 128*a*, 128*b*. In such case, only the replaceable clamping member would be selectable from different available shapes to adjust the dimensions and/or shape of the strain relief passageway.

Figure 6:
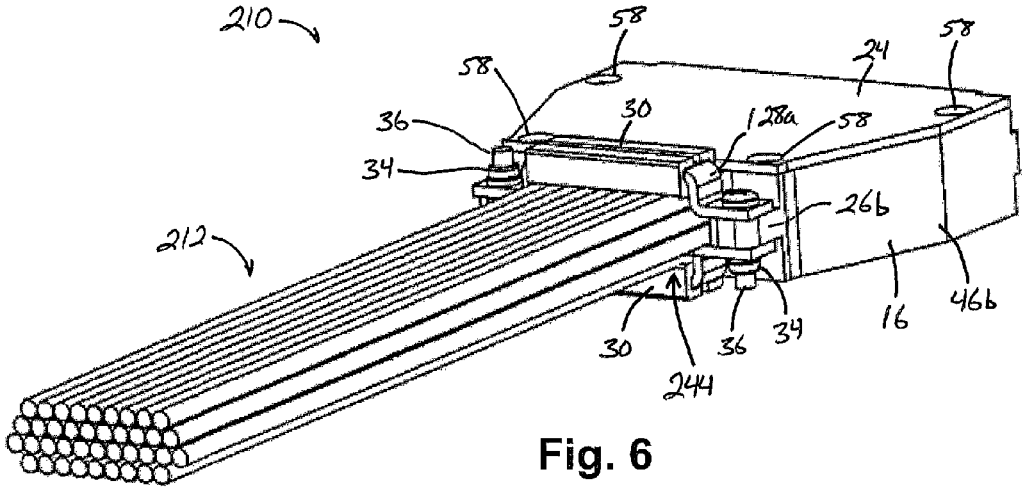
FIG. 6 is a perspective view of another embodiment of an electrical connector assembly, adapted to receive a four-row wire bundle.
Figure 7:
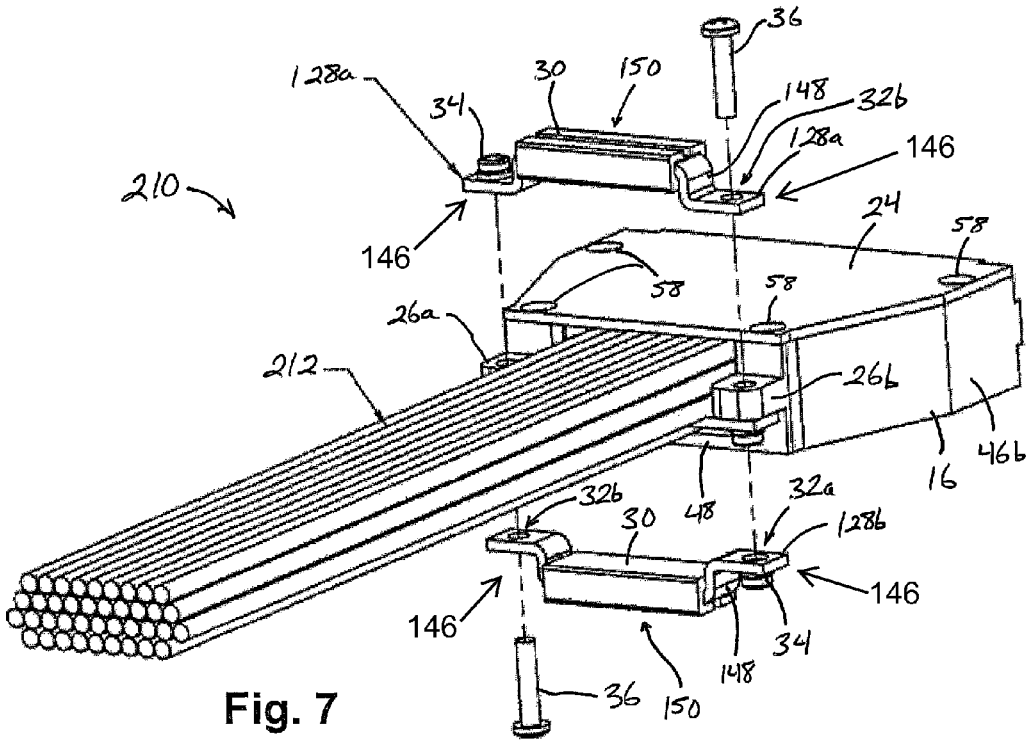
FIG. 7 is a partially exploded perspective view of the electrical connector assembly of FIG. 6.

In situations where a wire bundle 212 of even greater thickness than bundles 12, 112 is to be terminated in an electrical connector assembly 210, upper and lower U-shaped clamping members 128*a*, 128*b* may be selected and used together to provide a strain relief passageway 244 of even further increased height 'H' (FIGS. 6 and 7). Lower U-shaped clamping member 128*b* is substantially identical to upper U-shaped clamping member 128*a*, but as shown in FIGS. 6 and 7, is oriented in a mirror-image to upper clamping member 128*a*. It will be appreciated that the size of offset arms 148 may be adjusted to provide additional options in the size of the strain relief passageway, such as a third size of clamping member (not shown) having longer offset arms than arms 148 of clamping member 128*a*. Optionally, the middle region of each clamping member may be non-straight (such as bowed or curved) to better accommodate wire bundles that are round, oval, or non-rectangular in shape. Although shown and described herein primarily as a wire bundle comprising a plurality of individual wires arranged in generally flat configurations, it will further be appreciated that the connector assembly of the present invention may be adapted for use with a single wire, or with substantially any number of wires that may be accommodated by the connector.

To provide appropriate strain relief for different thicknesses of wire bundles, strain relief passageways 44, 144, 244 are selectable so that the height of the strain relief passageway defined between the resilient pads on the respective clamping members is at least slightly less than the height of the wire bundle that terminates at the electrical connector assembly. Accordingly, when threaded fasteners 36 are tightened, the resilient pads 30 on the clamping members are compressed against the wire bundle and deform slightly around the wire bundle in order to securely clamp the wire bundle before it enters the rear passageway 20 of housing 16.

Optionally, the orientation of the clamping members may be changed from those shown in FIGS. 4-7 to offset the respective wire bundle so that the bundle is not centered with rear passageway 20. For example, wire bundle 12 may be clamped between two resilient pads 30 on U-shaped clamping members similar to members 128*a*, 128*b*, except that the single weld-nut on each member would be replaced with an alternate connection device, such as a pair of weld-nuts on one clamping member and no weld-nuts on the other. By orienting both U-shaped clamping members in the same way (such as both in the manner of upper U-shaped clamping member 128*a* of FIGS. 4 and 5), the wire entry path into rear passageway 20 may be offset upwardly, such as may be desirable to reduce interference with other materials or to facilitate installation or work in the vicinity of the connector.

Figure 8:
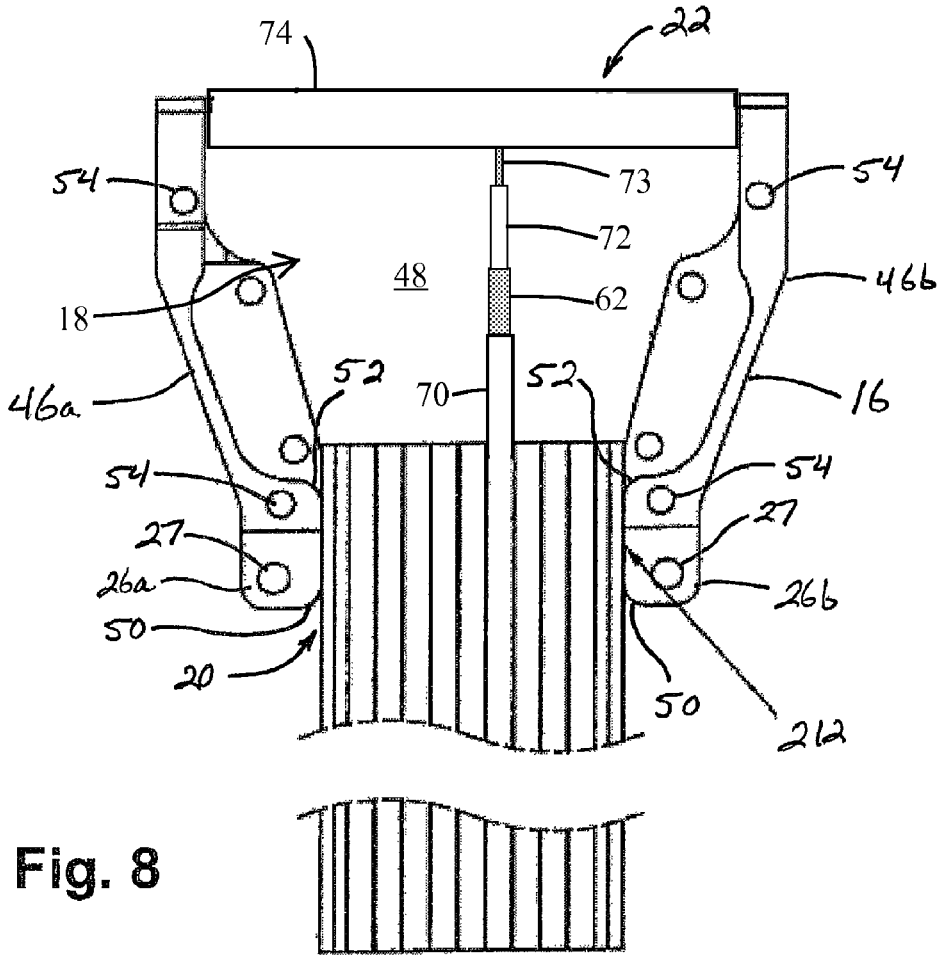
FIG. 8 is a top plan view of the electrical connector assembly of FIGS. 6 and 7 with its cover plate and clamping members removed.
Figure 9:
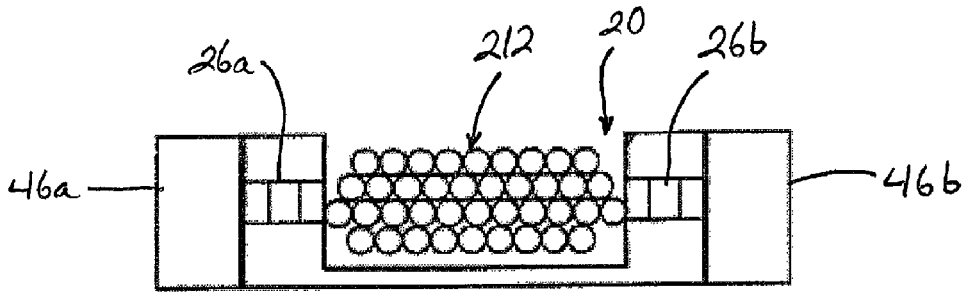
FIG. 9 is a rear end elevation of the electrical connector assembly of FIG. 8.
Figure 10:
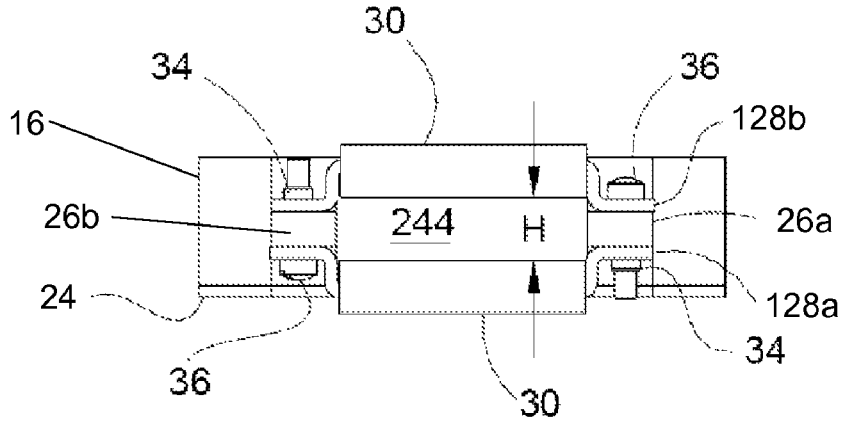
FIG. 10 is rear perspective view of the electrical connector assembly of FIGS. 6 and 7 having its wire bundle and cover plate removed.
Figure 11:
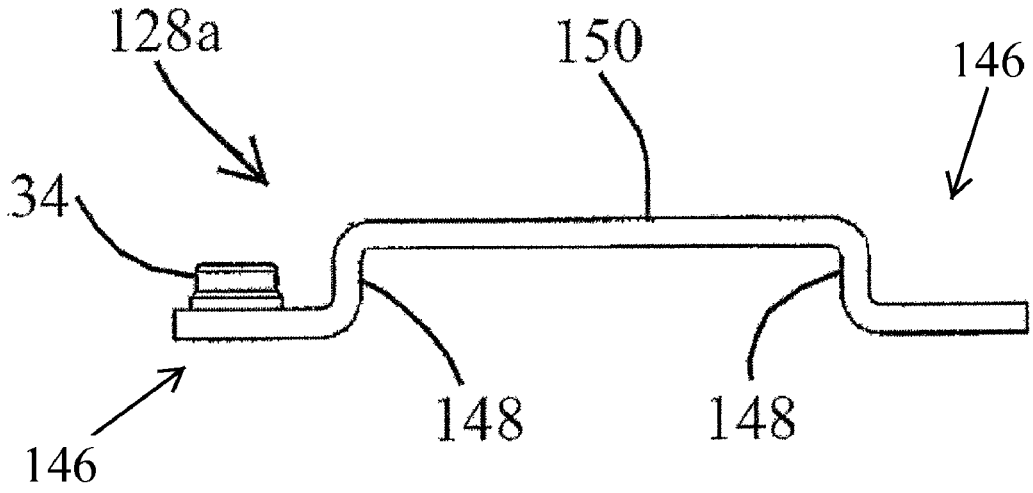
FIG. 11 is a side elevation of a clamping member.

Optionally, and with reference to FIGS. 8 and 9, housing 16 includes a pair of contoured side walls 46*a*, 46*b* that are integrally formed with, and held in spaced arrangement by a bottom plate 48 that spans between bottom portions of side walls 46*a*, 46*b*. Rear passageway 20 is generally rectangular in shape and bounded by rounded corners 50 of mounting surfaces 26*a*, 26*b*, and by rounded surfaces 52 inside of housing 16 facing cavity 18, which protect the wire bundle from abrading against sharp corners as it enters the cavity 18, particularly when large wire bundles are used. Threaded bores 54 are provided along upper surfaces of contoured side walls 46*a*, 46*b*, and are provided to receive threaded fasteners 56 that are driven through corresponding bores 58 in cover plate 24 (FIGS. 8 and 11).

The electrical connector assembly, including housing 16, cover plate 24, and clamp members 28*a*, 28*b* and 128*a*, 128*b*, is primarily made from metal, such as aluminum, or any sufficiently strong material to permit assembly and disassembly of the connector, although nonmetals including composites and molded plastics may also be suitable in certain applications, particularly where electrical conductivity is not required.

In the illustrated embodiments, each of the individual wires of the wire bundles includes one or more of an outer jacket 70, shielding material 62, an inner insulative jacket 72, and at least one conductor 73 (such as inside of inner insulative jacket), though it will be appreciated that the present invention may be used with substantially any type of wiring. Outer jacket 70 is contacted directly by the resilient pads 30, which are clamped against the outer jacket with sufficient compressive force to substantially limit or prevent movement of the wire end portions located inside of the housing. During assembly of the connector, shielding material 62 may be drawn away from inner insulative jacket 72 and electrically coupled to the housing, if desired.

The exposed inner insulative jackets 72 (and the conductors 73 contained therein) continue through the cavity 18 and terminate at a conventional electrical or electronic coupling assembly 74 (FIG. 8) such as a subminiature-D style connector or similar-proportioned rectangular connector, for example, which is coupled to the front end of housing 16 at front passageway 22. The electrical conductors 73 of the individual wires are soldered or otherwise electrically connected to individual couplers inside coupling assembly 74, such as at conventional pins or sockets or other contacts for coupling to another connector or electrical terminal for conducting electrical energy, voltage, signals, etc., such as at an avionic assembly or other electronic assembly. Once the connections are made inside the housing, the appropriate clamping members (i.e. either straight or U-shaped or a combination thereof) are selected according to the size of the wire bundle exiting the rear passageway of the housing to prevent fatigue or failure at the electrical connection between the conductors and the contacts in the coupling assembly. The clamping members are arranged so that their weld-nuts are positioned near respective opposite mounting surfaces of the housing, and threaded fasteners are inserted through both clamping members and the mounting surfaces, and tightened in the respective weld-nuts so that the resilient pads are compressed against the wire bundle to securely hold it in place.

Accordingly, the electronic connector assembly of the present invention includes an adjustable strain relief that accommodates various sizes of wire bundles, without limiting the effectiveness of the strain relief. By selecting an appropriate combination of straight clamps and U-shaped (or other shape) clamps, substantially any size of wire bundle that can be accommodated into the connector may be clamped between the pair of resilient pads that are compressed against the wire bundle by the clamps when the threaded fasteners are tightened.

Changes and modifications in the specifically-described embodiments may be carried out without departing from the principles of the present invention, which is intended to be limited only by the scope of the appended claims, as interpreted according to the principles of patent law including the doctrine of equivalents.

The embodiments of the invention in which an exclusive property is claimed are defined as follows:

1. An electrical connector assembly providing a strain relief for electrical wiring, said connector assembly comprising:

a housing, said housing defining a cavity adapted to receive an end portion of at least one wire, and a rear passageway adapted to receive the at least one wire into said cavity from outside of said housing;

a mounting surface at said housing, said mounting surface positioned near said rear passageway;

at least four clamping members adapted to be coupled to said mounting surface in spaced arrangement to define a strain relief passageway between selected ones of said clamping members, the dimensions of said strain relief passageway being selectable according to the respective shapes of said selected clamping members;

wherein a first pair of said clamping members comprises a first general shape corresponding to a relatively larger strain relief passageway, and a second pair of said clamping members comprises a second general shape different from said first general shape, said second pair of clamping members corresponding to a relatively smaller strain relief passageway that is smaller than said larger strain relief passageway; and wherein said strain relief passageway is adaptable to receive different sizes or quantities of wiring entering said cavity of said housing and to provide a strain relief to the wiring depending upon which two of said clamping members are at said mounting surface.

2. The electrical connector assembly of claim 1, wherein said second pair of clamping members comprises a generally straight shape and said first pair of clamping members comprises a U-shape as viewed in the longitudinal direction of the wiring entering said cavity of said housing.

3. The electrical connector assembly of claim 2, wherein said connector assembly is configurable to receive and provide a strain relief for a plurality of wires arranged in one or more rows.

4. The electrical connector assembly of claim 1, further comprising a third pair of clamping members comprising a third general shape different from said first and second general shapes of said first and second pairs of clamping members, wherein said third general shape corresponds to a medium size strain relief passageway that is smaller than said larger strain relief passageway of said first general shape and larger than said smaller strain relief passageway of said second general shape.

5. The electrical connector assembly of claim 1, wherein each of said first and second pairs of clamping members comprises a U-shape as viewed in the longitudinal direction of the wiring entering said cavity of said housing.

6. The electrical connector assembly of claim 5, wherein each of said first and second pairs of clamping members comprises a substantially straight portion having a length that generally corresponds to the width of said rear passageway of said housing.

7. The electrical connector assembly of claim 1, wherein one of said first pair of clamping members and one of said second pair of clamping members is coupled to a respective opposite side of said mounting surface.

8. The electrical connector assembly of claim 1, further comprising a removable cover at said housing, said removable cover adapted to substantially enclose said cavity of said housing.

9. The electrical connector assembly of claim 1, further comprising:

a front passageway in said housing; and an electronic coupling assembly adapted to receive conductors at the end portions of the wires, said electronic coupling assembly further adapted to align with said front passageway of said housing and to mateably receive a corresponding electrical connector.

10. The electrical connector assembly of claim 1, further comprising a resilient pad at each of said first and second clamping members, said resilient pads adapted to compressively engage said wire when said first and second clamping members are coupled to said mounting surface.

11. The electrical connector assembly of claim 10, wherein said resilient pads comprise an elastomeric material.

12. The electrical connector assembly of claim 10, wherein said resilient pads are interchangeable between said first and second clamping members.

13. The electrical connector assembly of claim 10, wherein said resilient pads comprise C-shaped channels adapted to receive a portion of said first and second clamping members.

14. The electrical connector assembly of claim 1, wherein said connector assembly is adapted to receive and provide a strain relief for either a second plurality of the wires arranged in two rows or a third plurality of the wires arranged in three or more rows.

15. The electrical connector assembly of claim 1, wherein said housing comprises rounded surfaces surrounding at least a portion of said rear passageway.

16. A method of terminating electrical wiring, said method comprising:

providing an electrical connector assembly having a housing defining a cavity and a mounting surface, and further providing at least one wire, at least four clamping members including a first pair having a first general shape and a second pair having a second general shape that is different from the first general shape, and an electronic coupling assembly;

electrically coupling the at least one wire to the electronic coupling assembly;

attaching the electronic coupling assembly at one end of the housing;

routing the at least one wire through the cavity of the housing and out through a rear passageway in the housing;

selecting a first clamping member from the at least four clamping members based on shape and according to the size or quantity of the at least one wire, leaving at least three remaining clamping members;

selecting a second clamping member from the remaining clamping members, based on shape and according to the size or quantity of the at least one wire and the shape of the selected first clamping member; and coupling the first clamping member and the second clamping member to the mounting surface of the housing so as to compress the first and second clamping members against the at least one wire to substantially prevent a portion of the at least one wire from moving relative to the first and second clamping members.

17. The method according to claim 16, wherein said plurality of clamping members comprise at least one straight clamping member and at least one non-straight clamping member.

18. The method according to claim 17, wherein said at least one non-straight clamping member comprises a U-shaped clamping member.

19. The method according to claim 16, further comprising:

providing a resilient pad having a channel adapted to receive a middle portion of at least one of the plurality of clamping members; and inserting at least one of the plurality of clamping members into the channel of the resilient pad prior to coupling the clamping member to the mounting surface of the housing so as to compress the resilient pad against the at least one wire.

* * * * *